US011341891B2

(12) United States Patent
Yang et al.

(10) Patent No.: US 11,341,891 B2
(45) Date of Patent: May 24, 2022

(54) DISPLAY PANEL ADJUSTMENT METHOD DIVIDING FAN-OUT MURA REGION

(71) Applicant: TCL CHINA STAR OPTOELECTRONICS TECHNOLOGY CO., LTD., Guangdong (CN)

(72) Inventors: Hui Yang, Guangdong (CN); Xiang Gao, Guangdong (CN)

(73) Assignee: TCL CHINA STAR OPTOELECTRONICS TECHNOLOGY CO., LTD., Shenzhen (CN)

( * ) Notice: Subject to any disclaimer, the term of this patent is extended or adjusted under 35 U.S.C. 154(b) by 0 days.

(21) Appl. No.: 15/734,884

(22) PCT Filed: Oct. 19, 2020

(86) PCT No.: PCT/CN2020/121900

§ 371 (c)(1),
(2) Date: Dec. 3, 2020

(65) Prior Publication Data

US 2022/0076605 A1 Mar. 10, 2022

(30) Foreign Application Priority Data

Sep. 10, 2020 (CN) ..... 202010945230.0

(51) Int. Cl.
*G09G 3/20* (2006.01)
*G09G 3/36* (2006.01)

(52) U.S. Cl.
CPC ..... *G09G 3/2007* (2013.01); *G09G 3/36* (2013.01); *G09G 2320/0233* (2013.01); *G09G 2320/0686* (2013.01); *G09G 2360/16* (2013.01)

(58) Field of Classification Search
None
See application file for complete search history.

(56) References Cited

U.S. PATENT DOCUMENTS

2013/0293528 A1 11/2013 Chen et al.
2015/0287385 A1* 10/2015 Wu ..... G09G 5/10 345/691
2016/0372442 A1* 12/2016 Han ..... H05K 1/117
2018/0233096 A1* 8/2018 Zhao ..... G02F 1/13306
2020/0320944 A1 10/2020 Zhang
(Continued)

FOREIGN PATENT DOCUMENTS

CN 104280907 A 1/2015
CN 105244001 A 1/2016
CN 108538264 A 9/2018
(Continued)

*Primary Examiner* — Chad M Dicke

(57) ABSTRACT

The present application provides a display panel adjustment method and an adjustment method for a display panel. A fan-out mura region of the display panel is divided into multiple first sub-regions along a first direction; according to an initial grayscale value of a first bonding point in the first sub-region, the fan-out mura degree and a first correction value of the corresponding first sub-region are obtained; and then grayscale compensation is performed on the corresponding first sub-region. The present application improves the mura effects in the fan-out region and improves the display quality of a product.

16 Claims, 3 Drawing Sheets

(56) References Cited

U.S. PATENT DOCUMENTS

2021/0074222 A1 3/2021 Meng

FOREIGN PATENT DOCUMENTS

| | | | |
|---|---|---|---|
| CN | 109119035 | A | 1/2019 |
| CN | 110176210 | A | 8/2019 |
| CN | 111009183 | A | 4/2020 |
| CN | 111028809 | A | 4/2020 |

* cited by examiner

DISPLAY PANEL ADJUSTMENT METHOD DIVIDING FAN-OUT MURA REGION

FIELD OF DISCLOSURE

The present application relates to a field of display technology and in particular, to a display panel adjustment method and an adjustment device for a display panel.

DESCRIPTION OF RELATED ART

Large-sized panels have resistance-capacitance (RC) delay problems which cause uneven charging of pixels in various areas and affect a product's image quality. In each data integrated circuit (Data IC) of a liquid crystal display panel, a length of a data line in the middle is shorter than a length of a data line on either of two sides. In other word, resistance and capacitance of a center line of the data integrated circuit is less than resistance and capacitance in a border. Therefore, in a short charging time, brightness of an edge portion of the data integrated circuit is significantly lower than brightness of a middle portion of the data integrated circuit. This phenomenon is called fan-out mura effects.

In conventional techniques, a fan-out mura effect is improved by controlling a charging time of lines in an edge portion and a middle portion of a data integrated circuit. However, the larger a panel size, the higher a refresh rate. Also, there is a greater difference in the charging effect between different areas, and the charging effect of each data integrated circuit is not the same. Therefore, it is difficult to make the two sides and the middle of each data integrated circuit have the same charging effect and to ensure uniformity across an entire surface.

In addition, the industry currently uses the line over driver (LOD) algorithm to improve the uniformity of image quality caused by insufficient charging of a display panel. Specifically, when charging voltages of adjacent pixels are not the same, an overdrive voltage is used to reduce an influence of cell data line resistance-capacitance (RC). The disadvantage is that the algorithm only allows a limited number of partitions. In prior art, each chip-on-flex or chip-on-film (COF for short) is divided into approximately 2 to 3 partitions, and a relationship between the fan-out area and the partitions changes subtly. Therefore, the partitions of the LOD algorithm cannot completely correspond to all the fan-out area, and as a result, it is difficult to make fine adjustments for the fan-out area.

Therefore, it is necessary to provide a display panel adjustment method and an adjustment device for a display panel to overcome the above-mentioned defects.

SUMMARY

The present application provides a display panel adjustment method and an adjustment device for a display panel, which can improve an uneven charging problem caused by a difference in lengths of a central data line and data lines at two sides in each data integrated circuit.

According to one embodiment of the present application, a display panel adjustment method is provided, comprising:

obtaining a fan-out mura region of the display panel, dividing the fan-out mura region along a first direction into a plurality of first sub-regions, wherein a width of the first sub-region at a middle portion of the fan-out mura region is less than a width of the first sub-region at an edge portion of the fan-out mura region, and each of the first sub-regions is provided with a first bonding point;

obtaining a fan-out mura degree of the corresponding first sub-region according to an initial grayscale value of the first bonding point;

calculating to obtain a corresponding first correction value for a current row of pixels in each first sub-region according to an initial grayscale value of a previous row of pixels and an initial grayscale value of a next row of pixels; and performing grayscale compensation on the corresponding first sub-region to obtain a compensated first display image according to the first correction value of each of the first sub-regions.

According to one embodiment of the present application, a display panel adjustment method is provided, comprising:

obtaining a fan-out mura region of the display panel, dividing the fan-out mura region along a first direction into a plurality of first sub-regions, wherein each of the first sub-regions is provided with a first bonding point;

obtaining a fan-out mura degree and a first correction value of the corresponding first sub-region according to an initial grayscale value of the first bonding point; and performing grayscale compensation on the corresponding first sub-region to obtain a compensated first display image according to the first correction value of each of the first sub-regions.

According to one embodiment of the present application, an adjustment device for a display panel is provided, comprising:

a partition unit for obtaining a fan-out mura region of the display panel and dividing the fan-out mura region along a first direction into a plurality of first sub-regions, wherein each of the first sub-regions is provided with a first bonding point;

an adjustment unit for obtaining a fan-out mura degree and a first correction value of the corresponding first sub-region according to an initial grayscale value of the first bonding point; and a compensation unit for performing grayscale compensation on the corresponding first sub-region according to the first correction value of each of the first sub-regions to obtain a compensated first display image.

The present application divides the fan-out mura region into partitions, and improves the adjustability of line over driver (LOD) algorithm by setting bonding points for the partitions. Furthermore, by means of the LOD algorithm, the present application solves the uneven charging problem caused by the different lengths of the central data line and the data lines at two sides in each data integrated circuit, improves mura effects in the fan-out region, ensures uniform image quality, and improves the display quality of a product.

BRIEF DESCRIPTION OF DRAWINGS

The following describes the present application in detail with reference to the accompanying drawings for ease of understanding of the technical solutions and other advantages of the present application.

DETAILED DESCRIPTION OF EMBODIMENTS

Figure 1:
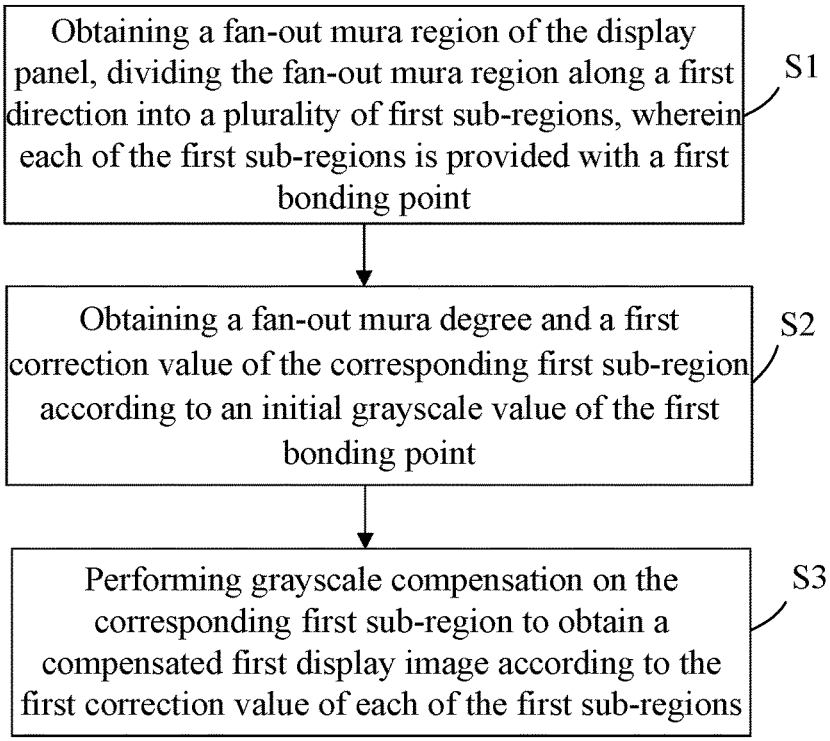
FIG. 1 is a process flow diagram illustrating a display panel adjustment method according to one embodiment of the present application.

The technical solutions in the present application will be clearly and completely described below in conjunction with the drawings in the embodiments of the present application. Obviously, the described embodiments are only some of the embodiments of the present application, rather than all the embodiments. Based on the embodiments in the present application, all other embodiments obtained by those skilled in the art without creative work should be deemed to be within the protection scope of the present application.

In the description of the present application, it should be understood that the terms "first" and "second" are only used for illustrative purposes, and cannot be understood as indicating or implying relative importance or implicitly indicating the number of the indicated technical features. Therefore, the features defined with "first" and "second" may explicitly or implicitly include one or more of the features. In the description of the present application, "multiple" means two or more than two, unless otherwise specifically defined.

The following disclosure provides many different embodiments or examples for realizing different structures of the present application. To simplify the disclosure of the present application, the components and configurations of specific examples are described below. Certainly, they are only examples and are not intended to limit the present application. In addition, the present application may repeat reference numerals and/or reference letters in different examples. Such repetition is for the purpose of simplification and clarity, and does not indicate the relationship between the various embodiments and/or configurations discussed.

Figure 2A:
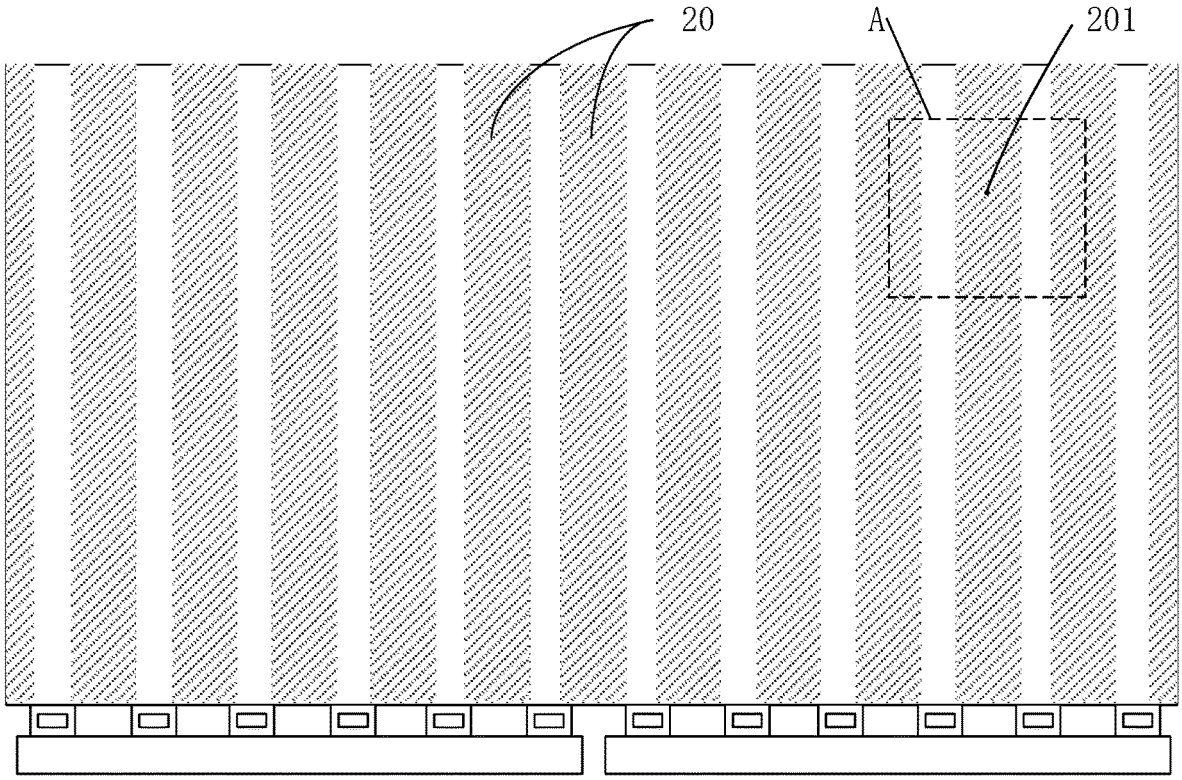
FIG. 2A is a schematic view illustrating fan-out mura effects before a display panel is adjusted.
Figure 2B:
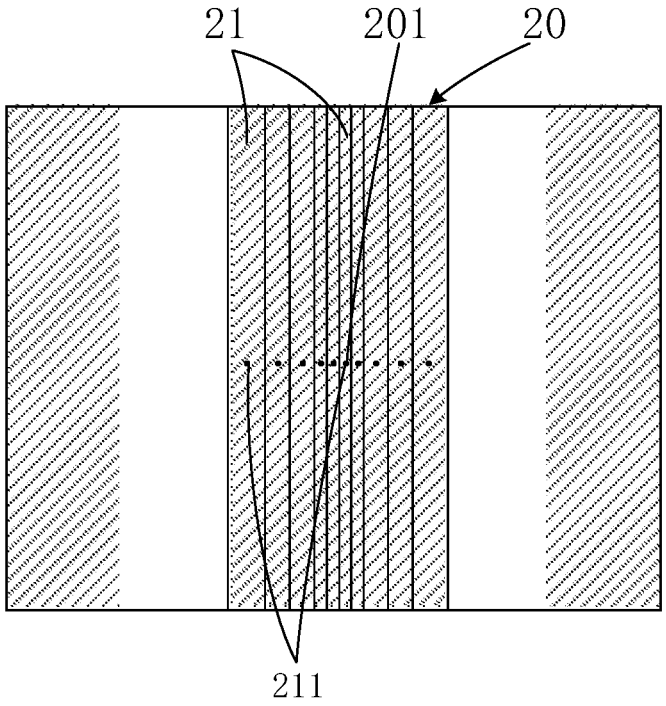
FIG. 2B is an enlarged schematic view illustrating area A in FIG. 2A.
Figure 3A:
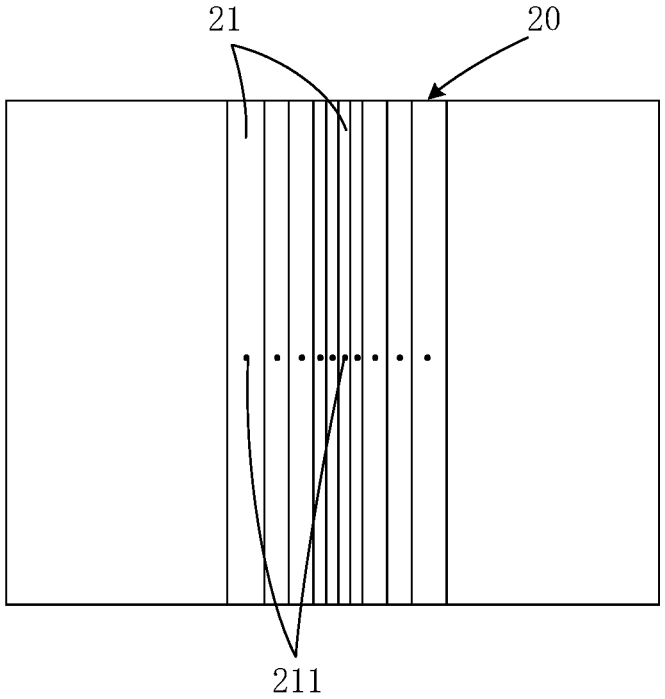
FIG. 3A is a schematic view illustrating that an area of the display panel is adjusted using the display panel adjustment method of the present application.
Figure 3B:
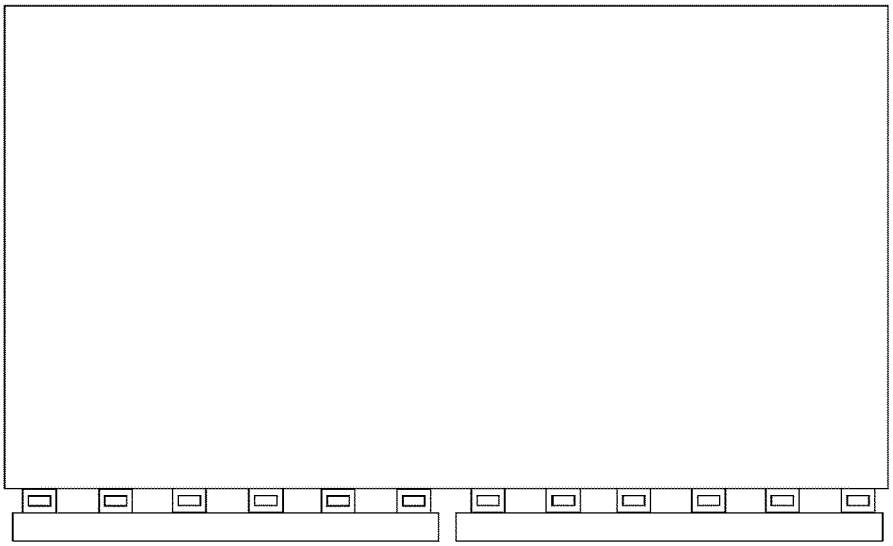
FIG. 3B is a schematic view illustrating the display panel after adjustments are made using the display panel adjustment method of the present application.
Figure 4:
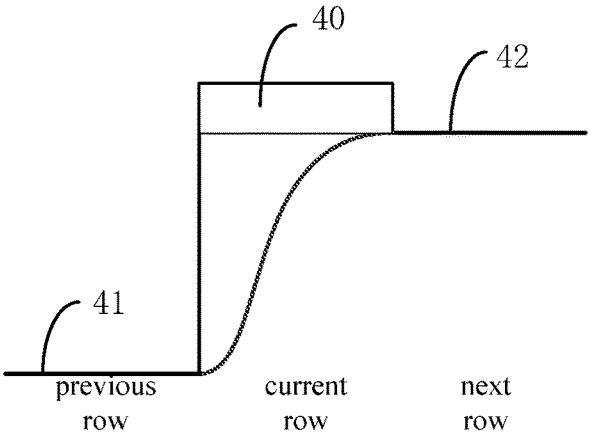
FIG. 4 is a schematic view illustrating line over driver technology.

Please refer to FIG. 1, FIG. 2A, FIG. 2B, FIG. 3A, FIG. 3B, and FIG. 4 together. FIG. 1 is a process flow diagram illustrating a display panel adjustment method according to one embodiment of the present application. FIG. 2A is a schematic view illustrating fan-out mura effects before a display panel is adjusted. FIG. 2B is an enlarged view illustrating area A in FIG. 2A, wherein the area A is an area between a midline of a mura pattern and midlines of its left and right adjacent mura patterns. FIG. 3A is a schematic view illustrating that the area A of the display panel is adjusted using the display panel adjustment method of the present application. FIG. 3B is a schematic view illustrating the display panel after adjustments are made using the display panel adjustment method. FIG. 4 is a schematic view illustrating line over driver (LOD) technology.

Referring to FIG. 1, the present application provides a display panel adjustment method, comprising:

S1: obtaining a fan-out mura region of the display panel, dividing the fan-out mura region along a first direction into a plurality of first sub-regions, wherein each of the first sub-regions is provided with a first bonding point;

S2: obtaining a fan-out mura degree and a first correction value of the corresponding first sub-region according to an initial grayscale value of the first bonding point; and S3: performing grayscale compensation on the corresponding first sub-region to obtain a compensated first display image according to the first correction value of each of the first sub-regions.

Step S1 is obtaining the fan-out mura region of the display panel, dividing the fan-out mura region along the first direction into the plurality of first sub-regions, wherein each of the first sub-regions is provided with the first bonding point. The first direction is a vertical direction of the display panel shown in the drawing.

As shown in FIG. 2A, uneven charging is caused by a difference between lengths of a central data line and data lines on two sides in each data integrated circuit. In a short charging time, brightness of the data integrated circuit at an edge portion is significantly lower than that at a middle portion, thus forming fan-out mura region 20. The fan-out mura effect is serious before the display panel is adjusted.

As shown in FIG. 2B, the present application divides the fan-out mura region 20 along the vertical direction into a plurality of first sub-regions 21 (in FIG. 2B, an area between any two adjacent vertical lines is the first sub-region). A first bonding point 211 is arranged in each of the first sub-regions 21.

In one embodiment, a width of the first sub-region 21 is a sum of widths of 4 to 16 pixels. The preferable width is the width of 4 pixels or 8 pixels or 16 pixels. Furthermore, a width of the first sub-region 21 in a middle portion of the fan-out mura region 20 is less than a width of the first sub-region 21 in an edge portion of the fan-out mura region 20.

A liquid crystal display panel usually adopts a pixel driving circuit with a flip pixel structure, and a plurality of data lines extend in a vertical direction. Along the vertical direction, the fan-out mura region 20 is divided by the width of 4, 8 or 16 pixels to obtain the corresponding first sub-regions 21.

In the present embodiment, a width W1 of the first sub-region 21 in the middle portion of the fan-out mura region 20 is 4 pixels wide, and a width W2 of the first sub-region 21 at the edge portion of the fan-out mura region 20 is 16 pixels wide, and a width W3 of the first sub-region 21 at other portion of the fan-out mura region 20 is 8 pixels wide. The present application is not intended to limit a size of each of the first sub-regions 21. In terms of resource consumption, the larger a partition (sub-region), the more resources are required. The smaller a partition, the more areas (sub-regions) are obtained, and the more time and cost are required. In setting the partitions, attention should be paid to achieving a balance between uniformity and resource consumption.

The display panel adjustment method further comprises: providing an area bonding point in the fan-out mura region, such as the area bonding point 201 shown in FIG. 2A.

In one embodiment, the area bonding point 201 coincides with one first bonding point 211 corresponding to the first sub-region 21, as shown in FIG. 2B. That is to say, the area bonding point 201 is included in the set of the first bonding points 211. FIG. 2B is only an example showing the arrangement of the first bonding points 211. Those skilled in the art can realize that the first bonding point 211 can have other configuration in the first sub-region 21, and are not limited to be located in the middle of the corresponding sub-region.

Step S2 is obtaining the fan-out mura degree and the first correction value of the corresponding first sub-region according to the initial grayscale value of the first bonding point. In detail, step S2 further comprises:

Step S21: obtaining the fan-out mura degree of the corresponding first sub-region according to the initial grayscale value of the first bonding point;

Step S22: calculating to obtain the corresponding first correction value for a current row of pixels in each of the first sub-regions according to the initial grayscale value of a previous row of pixels and the initial grayscale value of a next row of pixels.

In step S21, the fan-out mura degree can be calculated by an analysis device, and then obtained according to a difference between the initial grayscale value of the first bonding point 211 and a preset target grayscale value. The analysis device can be a CA310 color analyzer; however, the present application does not limit the type of the analysis device.

In step S22, through adjustment, the first sub-region 21 currently operated has a uniform brightness, that is, a first grayscale value. Generally, the first grayscale value is a median of the initial grayscale values of all pixels in the first sub-region 21, or the first grayscale value is a grayscale value closest to the target grayscale value. A control voltage is adjusted within a voltage range corresponding to the initial grayscale value of each pixel of the first sub-region 21 currently operated, so that each pixel reaches the first grayscale value after adjustment. The first correction value 40 can be obtained by searching a preset overdrive correction table. As shown in FIG. 4, the first correction value 40 is an overdrive voltage value. Specifically, the image processing is performed on the display panel through camera shooting. For the current row of pixels in each of the first sub-regions 21, when a charging voltage of the initial grayscale value 41 of the current row of pixels is not the same as a charging voltage of the initial grayscale value 42 of the next row of pixels, the first correction value 40 is set between the pixels of the previous row and the pixels of the next row to reduce the influence of the resistance and capacitance of the data line of the panel.

In one embodiment, each pixel in the first sub-region is made to have the same first grayscale value, and the first correction value is adjusted according to the first grayscale value. The first correction value 40 can be adjusted by performing linear interpolation on the first sub-region 21. Generally, the grayscale value is used to indicate the degree of brightness. The higher the grayscale value, the higher (brighter) the brightness; the lower the grayscale value, the lower (darker) the brightness. Specifically, by performing linear interpolation on the first sub-region 21, the first correction value 40 of the first sub-region 21 with a larger first grayscale value (i.e., a higher brightness) is increased; the first correction value 40 of the first sub-region 21 with a smaller first grayscale value (i.e., a lower brightness) is decreased.

Step S3 is performing grayscale compensation on the corresponding first sub-region 21 to obtain a compensated first display image according to the first correction value 40 of each of the first sub-regions 21.

Specifically, in the output first display image, there is substantially the same brightness grayscale for each of the first sub-regions 21, as shown in FIG. 3A and FIG. 3B.

In another embodiment, the display panel adjustment method further comprises: dividing the fan-out mura region 20 along a second direction into a plurality of second sub-regions, wherein each of the second sub-regions is provided with a second bonding point; obtaining a corresponding second correction value according to an initial grayscale value of the second bonding point; and performing grayscale compensation on the corresponding second sub-region to obtain a compensated second display image according to the second correction value. The second direction is perpendicular to the first direction, and the second direction is a horizontal direction of the display panel shown in FIG. 2A.

Selectively, the area bonding point 201 coincides with one second bonding point corresponding to the second sub-region.

Specifically, in practice, a mura pattern of the fan-out mura region 20 changes relatively slowly in the vertical direction shown in FIG. 2A. Therefore, the number of the second sub-regions can be reduced compared to the number of the first sub-regions to avoid waste of resources.

The present application divides the fan-out mura region into partitions, and improves the adjustability of line over driver (LOD) algorithm by setting bonding points for the partitions. Furthermore, the present application solves the uneven charging problem caused by different lengths of the central data line and the data lines at two sides in each data integrated circuit, improves the mura effects in the fan-out region, ensures uniform image quality, and improves the product display quality.

Figure 5:
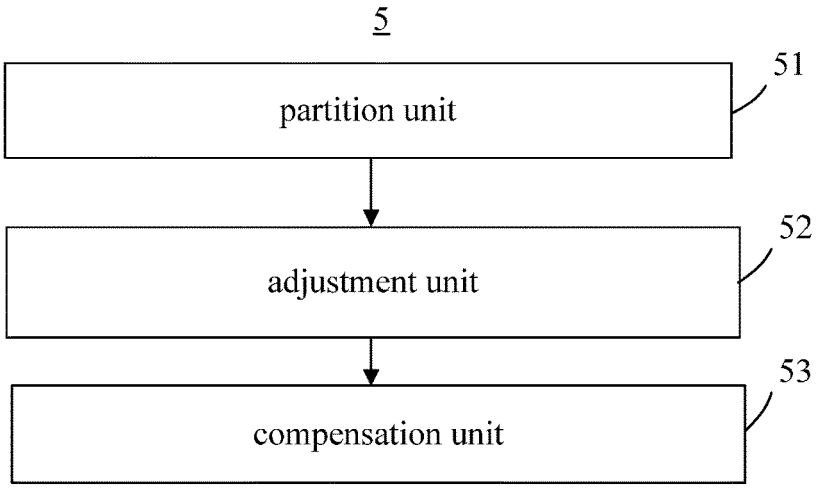
FIG. 5 is a schematic view illustrating an adjustment device for a display panel according to one embodiment of the present application.

Based on the same inventive concept, the present application also provides an adjustment device for a display panel. FIG. 5 is a structural diagram illustrating the adjustment device for the display panel according to one embodiment of the present application. As shown in FIG. 5, the adjustment device 5 for the display panel comprises: a partition unit 51, an adjustment unit 52, and a compensation unit 53.

The partition unit 51 is configured to obtain a fan-out mura region of the display panel and divide the fan-out mura region along a first direction into a plurality of first sub-regions, wherein each of the first sub-regions is provided with a first bonding point.

The adjustment unit 52 is configured to obtain a fan-out mura degree and a first correction value of the corresponding first sub-region according to an initial grayscale value of the first bonding point.

The compensation unit 53 is configured for performing grayscale compensation on the corresponding first sub-region according to the first correction value of each of the first sub-regions to obtain a compensated first display image.

The adjustment device for the display panel in the present embodiment and the display panel adjustment method of the above-mentioned embodiment are based on the same inventive concept. For technical details that are not described in detail in the present embodiment, please refer to the above-mentioned embodiment, and the present embodiment has all advantages of the above-mentioned embodiment, that is, the present embodiments divides up the fan-out mura region into partitions, and improves the adjustability of the line over driver (LOD) algorithm by setting bonding points for the partitions. Furthermore, the present embodiment solves the uneven charging problem caused by the different lengths of the central data line and the data lines at two sides in each data integrated circuit, improves the mura effects in the fan-out region, ensures uniform image quality, and improves the product display quality.

In the above-mentioned embodiments, the description of each embodiment has its own emphasis. For those that are not described in detail in one embodiment, reference may be made to related descriptions of other embodiments.

It should be noted that for those of ordinary skill in the art, equivalent substitutions or changes can be made according to the technical solutions and inventive concepts of the present application, and all these changes or substitutions shall fall within the protection scope of the appended claims of the present application.

What is claimed is:

1. A display panel adjustment method, comprising:

obtaining a fan-out mura region of the display panel, dividing the fan-out mura region in a first direction into a plurality of first sub-regions, wherein a width of the first sub-region at a middle portion of the fan-out mura region is less than a width of the first sub-region at an edge portion of the fan-out mura region, and each of the first sub-regions is provided with a first bonding point;

obtaining a fan-out mura degree of the corresponding first sub-region according to an initial grayscale value of the first bonding point;

calculating to obtain a corresponding first correction value for a current row of pixels in each first sub-region according to an initial grayscale value of a previous row of pixels and an initial grayscale value of a next row of pixels; and performing gray-scale compensation on the corresponding first sub-region to obtain a compensated first display image according to the first correction value of each of the first sub-regions.

2. The display panel adjustment method according to claim 1, wherein a width of the first sub-region is a sum of widths of 4 to 16 pixels.

3. The display panel adjustment method according to claim 1, the step of, for the current row of pixels in each of the first sub-regions, calculating to obtain the corresponding first correction value according to the initial grayscale value of the previous row of pixels and the initial grayscale value of the next row of pixels comprises:

making each pixel in the first sub-region have a same first grayscale value, and then adjusting the first correction value according to the first grayscale value.

4. The display panel adjustment method according to claim 3, wherein the step of adjusting the first correction value according to the first grayscale value comprises performing linear interpolation on the first sub-region to adjust the first correction value.

5. The display panel adjustment method according to claim 1, wherein the method further comprises: providing an area bonding point in the fan-out mura region.

6. The display panel adjustment method according to claim 5, wherein the area bonding point coincides with one first bonding point corresponding to the first sub-region.

7. The display panel adjustment method according to claim 5, wherein the method further comprises:

dividing the fan-out mura region along a second direction into a number of second sub-regions, wherein the second direction is perpendicular to the first direction, and each of the second sub-regions is provided with a first second bonding point;

obtaining a corresponding second correction value according to an initial grayscale value of the second bonding point; and performing grayscale compensation on the corresponding second sub-region to obtain a compensated second display image according to the second correction value.

8. The display panel adjustment method according to claim 7, wherein the area bonding point coincides with one second bonding point corresponding to the second sub-region.

9. A display panel adjustment method, comprising:

obtaining a fan-out mura region of the display panel, dividing the fan-out mura region in a first direction into a plurality of first sub-regions, wherein each of the first sub-regions is provided with a first bonding point;

obtaining a fan-out mura degree and a first correction value of the corresponding first sub-region according to an initial grayscale value of the first bonding point; and performing grayscale compensation on the corresponding first sub-region to obtain a compensated first display image according to the first correction value of each of the first sub-regions, wherein the step of obtaining the fan-out mura degree and the first correction value of the corresponding first sub-region according to the initial grayscale value of the first bonding point comprises:

obtaining the fan-out mura degree of the corresponding first sub-region according to the initial grayscale value of the first bonding point;

calculating to obtain the corresponding first correction value for the current row of pixels in each of the first sub-regions according to the initial grayscale value of the previous row of pixels and the initial grayscale value of the next row of pixels; and making each pixel in the first sub-region have the same first grayscale value, and then adjusting the first correction value according to the first grayscale value.

10. The display panel adjustment method according to claim 9, wherein a width of the first sub-region is a sum of widths of 4 to 16 pixels.

11. The display panel adjustment method according to claim 9, wherein a width of the first sub-region at a middle portion of the fan-out mura region is less than a width of the first sub-region at an edge portion of the fan-out mura region.

12. The display panel adjustment method according to claim 9, wherein the step of adjusting the first correction value according to the first grayscale value comprises performing linear interpolation on the first sub-region to adjust the first correction value.

13. The display panel adjustment method according to claim 9, wherein the method further comprises: providing an area bonding point in the fan-out mura region.

14. The display panel adjustment method according to claim 13, wherein the area bonding point coincides with one first bonding point corresponding to the first sub-region.

15. The display panel adjustment method according to claim 13, wherein the method further comprises:

dividing the fan-out mura region along a second direction into a number of second sub-regions, wherein the second direction is perpendicular to the first direction, and each of the second sub-regions is provided with a first second bonding point;

obtaining a corresponding second correction value according to an initial grayscale value of the second bonding point; and performing grayscale compensation on the corresponding second sub-region to obtain a compensated second display image according to the second correction value.

16. The display panel adjustment method according to claim 15, wherein the area bonding point coincides with one second bonding point corresponding to the second sub-region.

* * * * *